United States Patent [19]

Brock et al.

[11] Patent Number: 4,867,572

[45] Date of Patent: Sep. 19, 1989

[54] ASPHALT PLANT WITH FIXED SLEEVE MIXER

[75] Inventors: J. Don Brock, Chattanooga; James G. May, Hixson, both of Tenn.

[73] Assignee: Astec Industries, Inc., Chattanooga, Tenn.

[21] Appl. No.: 307,176

[22] Filed: Feb. 3, 1989

Related U.S. Application Data

[63] Continuation of Ser. No. 93,915, Sep. 8, 1987, abandoned.

[51] Int. Cl.[4] ..... B28C 5/06

[52] U.S. Cl. ..... 366/25; 366/15; 366/40; 366/233; 366/235

[58] Field of Search ..... 366/22-25, 366/27, 15, 42, 40, 53, 62, 233-235; 432/106, 105

[56] References Cited

U.S. PATENT DOCUMENTS

| | | | |
|---|---|---|---|
| Re. 31,904 | 6/1985 | Mendenhall | 366/25 |
| Re. 31,905 | 6/1985 | Mendenhall | 106/281 R |
| 2,421,345 | 5/1947 | McConnaughay | 366/25 |
| 2,487,887 | 11/1949 | McEachran . | |
| 4,136,966 | 1/1979 | Mendenhall | 366/25 |
| 4,600,379 | 7/1986 | Elliott | 432/13 |
| 4,616,934 | 10/1986 | Brock | 366/4 |
| 4,813,784 | 3/1989 | Musil | 366/24 |

OTHER PUBLICATIONS

Smith, A Summer of Recycling Hot-Mix Asphalt Pavements, PAVING FORUM, Winter, 1978, third column of p. 6.

Hot Mix Recycling Project is Nation's First Using Conventional Equipment, CONSTRUCTION BULLETIN, Oct. 1, 1976.

*Primary Examiner*—Timothy F. Simone

*Attorney, Agent, or Firm*—Jones, Askew & Lunsford

[57] ABSTRACT

An asphalt plant apparatus includes an inclined rotary drum dryer, the lower end of which is received within a concentric fixed sleeve. Aggregate is introduced into the upper end of the rotary drum dryer for heating and drying and is discharged from the lower end of the drum into an annular space between the drum and the concentric fixed sleeve. Recycleable asphalt pavement (RAP) and fines may be introduced into the annular space along with the heated and dried aggregate. Flights on the exterior of the rotating drum mix the aggregate and RAP and move the mixture toward the opposite end of the concentric fixed sleeve, heat from the heated aggregate, from the flights, and from the hot shell of the drum melting the asphaltic content of the RAP. Liquid asphalt is introduced into the sleeve for mixing along with the aggregate and RAP, and the resulting mixture is discharged from the sleeve for use as an asphalt paving composition.

7 Claims, 3 Drawing Sheets

ASPHALT PLANT WITH FIXED SLEEVE MIXER

This is a continuation of application Ser. No. 093,915, filed Sept. 8, 1987 now abandoned.

TECHNICAL FIELD

The present invention relates generally to apparatus for manufacturing asphalt paving composition, and relates more specifically to a continuous mix asphalt plant having a rotary drum dryer and a concentric fixed sleeve mixer.

BACKGROUND OF THE INVENTION

Apparatus for manufacturing asphalt paving composition as well-known. Stated broadly, asphalt plants include a means for heating and drying virgin aggregate and a means for mixing the heated and dried aggregate together with liquid asphalt to form a paving composition. Optionally, recycleable asphalt pavement (commonly referred to as "RAP") is also included in the mix. The RAP must be heated sufficiently to melt the asphalt therein so that the components of the RAP can become thoroughly intermixed with the virgin aggregate and liquid asphalt.

Asphalt plants can be divided into two broad categories: batch plants and continuous-mix plants. In a batch plant, a quantity of virgin aggregate is heated and dried and dumped into a mixer along with a proportional quantity of liquid asphalt. The batch of aggregate and liquid asphalt is then thoroughly mixed and discharged into a storage bin so that the next batch can be prepared.

By far the preferred type of plant today is the continuous-mix plant. In a continuous-mix plant, ingredients are continuously being introduced into the plant, and asphalt paving composition is continuously being discharged from the plant, rather than manufacturing the asphalt paving composition in batches. Since materials are continuously being introduced, the proportions of the components in the mix must be controlled by controlling the relative rates at which the various components are introduced into the plant, rather than by merely controlling the relative quantities of the various components. Continuous-mix plants generally fall into one of two categories. In the first type of continuous-mix plant, virgin aggregate is heated and dried in a drum dryer. The heated and dried aggregate is then discharged into a separate mixing device, such as a pugmill. Liquid asphalt is then introduced into the mixer along with the aggregate and is thoroughly mixed, the resulting asphalt paving composition being discharged from the other end of the mixer.

In a second type of continuous-mix plant, known as a "drum mixer," the drying and mixing processes are both carried out in a single rotating drum. Virgin aggregate is introduced into the upper end of the rotating drum. A burner mounted in the upper end of the drum heats the air flowing through the drum, and the aggregate is heated and dried as it is tumbled through the heated airflow in the upper end of the drum. Liquid asphalt is introduced into the drum at a point sufficiently removed downstream from the burner so that the liquid asphalt will not smoke. The heated and dried aggregate and the liquid asphalt are then mixed in the bottom portion of the drum, and the asphalt paving composition is discharged out the lower end of the drum. Air removed from the drum is typically ducted to a dust-collection system, such as a baghouse, wet-washer, or cyclone separator.

RAP can be included as a component of the asphalt mix in either of these two varieties of continuous-mix plants. In the first type of continuous-mix plant comprising a dryer and separate coater, the RAP is introduced either into the lower end of the dryer at a point sufficiently removed from the burner that the asphalt in the RAP does not smoke excessively; or, the RAP can be introduced into the mixer along with super-heated aggregate, the heat from the aggregate melting the asphalt in the RAP so that the components of the RAP can be thoroughly intermixed with the aggregate and liquid asphalt. In the case of a drum mixer, the RAP is introduced into a mid-point of the drum, either radially through ports in the circumference of the drum or axially from the lower end of the drum. The RAP is introduced into the drum mixer at a point where the temperature is sufficiently high to melt the RAP but not so high as to cause the asphalt in the RAP to smoke excessively. The aggregate, melted RAP, and liquid asphalt are then mixed in the lower portion of the drum, with the asphalt paving composition being discharged from the bottom end of the drum.

One of the primary difficulties in designing asphalt plant apparatus concerns the need for providing a high temperature zone for heating and drying the virgin aggregate while shielding liquid asphalt and RAP from such high temperatures as would cause the asphalt to smoke or burn. The drum dryer and separate coater has obvious advantages in this respect, since the liquid asphalt and RAP need not be exposed within the same vessel used for heating and drying the aggregate. However, such designs suffer the disadvantages of higher cost, both in manufacturing two separate components and in the energy costs of driving the dryer and a separate coater. Further, these designs are typically bulkier and hence less portable than drum mixers. Conversely, drum mixers are less expensive to operate and more portable. However, the liquid asphalt and RAP must be exposed within the same vessel used to heat and dry the aggregate. Thus, the design must provide a drum of sufficient length that the liquid asphalt and RAP can be introduced at a point removed from the intense heat of the burner while still providing sufficient exposure within the drum to afford adequate opportunity for mixing. If the drum is made too short, either capacity will suffer, or the liquid asphalt and RAP will smoke excessively and create a pollution problem.

A further problem with prior-art drum mixers is that they are not thermally efficient. In a prior art drum mixer, since asphalt cannot be exposed in the proximity of the flame, all materials must move through the drum in the direction away from the flame. Since the flow of material is thus moving in the same direction as the flow of heated gases moving through the drum, such an arrangement is known as "parallel flow" or "concurrent flow." While a parallel flow design keeps asphalt from coming too close to the flame and burning or smoking, such a design is less efficient in drying damp aggregate than a "counterflow" arrangement, where the materials flow toward the burner counter to the direction of the airflow through the drum. In a concurrent-flow dryer, the aggregate is exposed to the highest temperatures while it is still cold and damp. By the time the aggregate begins to get heated, it has moved down the drum into a cooler zone. In contrast, as aggregate is heated in a counterflow dryer, it moves into a higher temperature zone, and it is exposed to the highest temperatures immediately prior to being discharged from the drum. Thus, a counterflow arrangement is thermodynamically more efficient. Prior-art drum mixers thus suffer the disadvantage of drying aggregate in a parallel flow drying zone and thus sacrifice the thermal efficiency of a concurrent flow design.

An additional problem with prior art drum mixers is that of exposing liquid asphalt to steam and high temperatures present within the drum mixer. As aggregate is dried in the upper end of the drum, steam is generated. Contact with this steam can strip light end hydrocarbons from the liquid asphalt. The stripped light end hydrocarbons can condense on the walls and filters of the baghouse, clogging the filter elements and reducing plant capacity. Oil-soaked bags further lead to a higher probability of baghouse fires. Finally, the light end hydrocarbons can be released through the stack and into the atmosphere, creating pollution problems. The problem of stripping light end hydrocarbons becomes even more pronounced when recycling used asphaltic pavement, since the softer liquid asphalts used to compensate for the harder asphalt in the RAP will have more light end hydrocarbons.

Accordingly, there is a need to provide an improved apparatus for manufacturing asphalt paving composition which avoids the problem of exposing liquid asphalt and RAP to high temperatures which can cause smoking or burning.

There is a further need to provide an improved apparatus for manufacturing asphalt paving composition which efficiently segregates the drying and mixing functions.

There is also a need to provide an improved apparatus for manufacturing asphalt paving composition which protects liquid asphalt against exposure to steam which can strip light end hydrocarbons from the liquid asphalt and cause pollution problems.

GENERAL DESCRIPTION OF THE INVENTION

As will be seen, the present invention overcomes these and other problems associated with prior art apparatus for manufacturing asphalt paving composition. Stated generally, the present invention comprises an asphalt plant apparatus which provides for the efficient heating and drying of virgin aggregate in a high temperature environment, without exposing liquid asphalt and RAP to high temperatures which can cause burning and smoking, or to steam which can strip light end hydrocarbons from the liquid asphalt.

Generally described, the present invention provides an apparatus and method for introducing aggregate into the upper end of a rotary drum; heating the interior of the drum to heat the aggregate; moving the aggregate along the drum and discharging the aggregate from the drum into a stationary sleeve positioned adjacent to the drum; introducing asphalt binder material into the sleeve with the aggregate; mixing the aggregate and asphalt binder material and moving the mixture along the space formed between said drum and the sleeve; and discharging the mixture from the sleeve.

Stated somewhat more specifically, the asphalt plant of the present invention comprises a drum dryer mounted for rotation about its longitudinal axis. The longitudinal axis of the drum is inclined with respect to horizontal, such that the drum has an upper end and a lower end. A cylindrical fixed sleeve concentric with the drum is disposed to receive the lower end of the drum for rotation within the sleeve. The inner diameter of the sleeve is larger than the outer diameter of the drum, such that an annular space is defined between the drum and the sleeve. The drum and sleeve may be mounted to a frame to provide portability.

The asphalt plant apparatus further comprises a burner mounted in the lower end of the drum for heating the interior of the drum and an inlet for introducing aggregate into the upper end of the drum. As the drum rotates, the aggregate is tumbled down the drum through a flow of heated air. The heated and dried aggregate is discharged from the lower end of the drum into the annular space between the drum and the sleeve.

RAP may be introduced into the asphalt plant directly into the annular space between the drum and the sleeve, thereby avoiding exposure to the high temperatures present within the drum. Flights or mixing blades on the exterior of the drum mix the aggregate and RAP within the annular space as the drum rotates and move the mixture of aggregate and RAP along the sleeve. The RAP, is heated by contact with the heated aggregate, by conductive heat from the flights on the exterior of the drum, and by radiant heat from the shell of the drum, sufficiently to melt the asphalt in the RAP. However, the RAP is shielded from the direct radiant heat of the burner by the shell of the drum, preventing it from being overheated and smoking or burning. Further along the sleeve, liquid asphalt is introduced into the annular space along with the mixture of aggregate and RAP and is mixed therewith by the flights on the exterior of the rotating drum. Again, the liquid asphalt is shielded from the direct radiant heat of the burner by the walls of the drum. The aggregate, RAP, and liquid asphalt are thus mixed and moved along by the flights on the exterior of the rotating drum. The resulting mixture is discharged from the sleeve suitable for use as an asphalt paving composition.

Thus, it is an object of the present invention to provide an improved apparatus for manufacturing asphalt paving composition either using all virgin materials or using some recycleable materials.

It is a further object of the present invention to provide an improved apparatus for recycling used asphalt pavement for use as an additive in manufacturing asphalt paving composition.

It is another object of the present invention to provide an apparatus for recycling asphalt pavement which heats the RAP without smoking or burning the asphaltic content of the RAP.

It is yet another object of the present invention to provide an apparatus for manufacturing asphalt paving composition which isolates liquid asphalt from exposure to steam and prevents the smoking and burning of the liquid asphalt.

Another object of the present invention is to provide an apparatus for manufacturing asphalt paving composition which is inexpensive to manufacture and operate, and provides high thermal efficiency.

Other objects, features, and advantages will become apparent upon reading the specification, when taken in conjunction with the drawing and the appended claims.

DETAILED DESCRIPTION OF THE DISCLOSED EMBODIMENT

Figure 1:
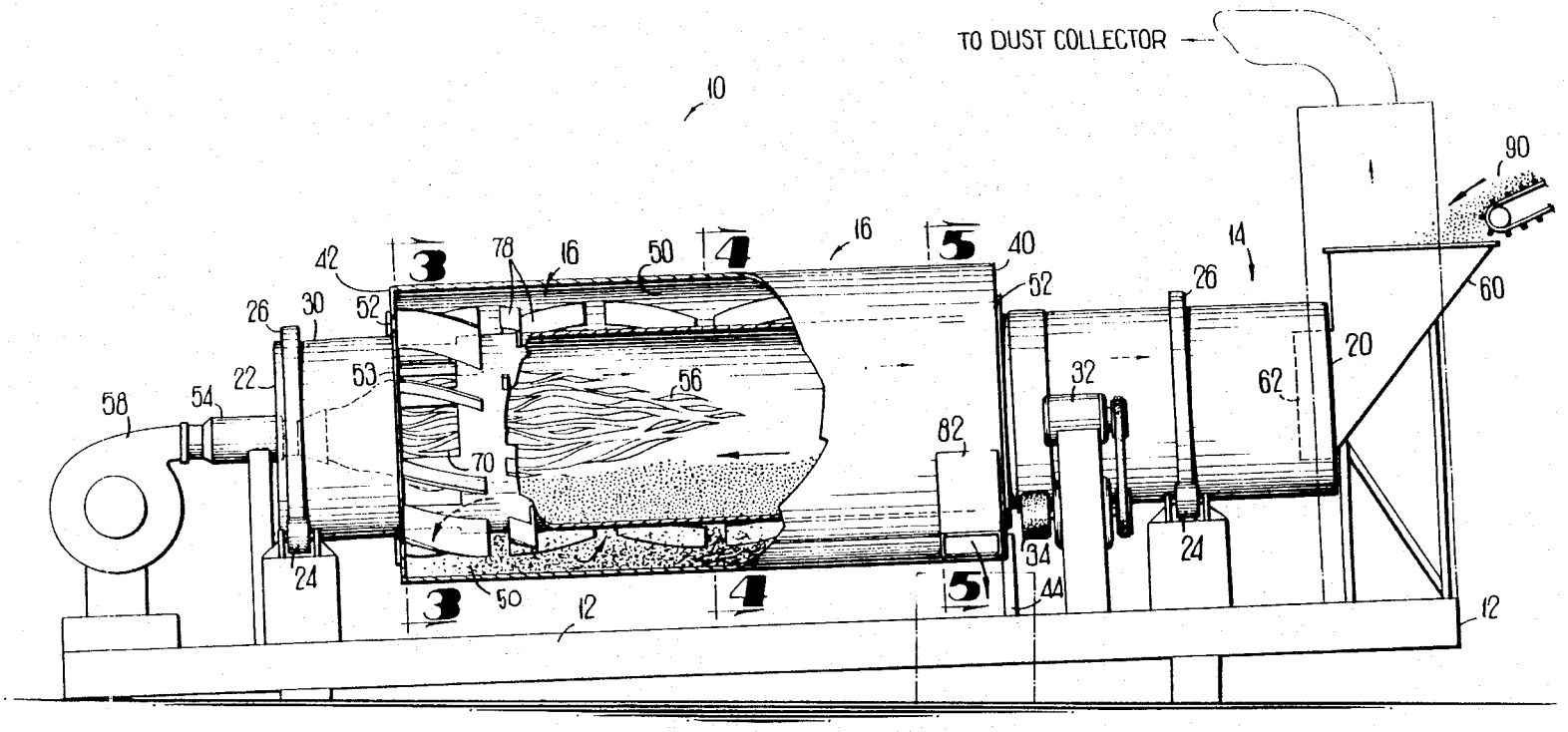
FIG. 1 is a partially cut-away side view of an asphalt plant according to the present invention.

Referring now to the drawings, in which like numerals indicate like elements throughout the several views, FIG. 1 shows an asphalt plant apparatus 10 according to the present invention. The asphalt plant apparatus 10 is supported on a frame 12 and includes a rotary drum 14 and a cylindrical fixed sleeve mixer 16. The frame 12 may be mounted on wheels (not shown) for transport from one job site to another.

The drum 14 is mounted for rotation about its longitudinal axis. The longitudinal axis of the drum 14 is inclined with respect to horizontal such that the drum has an upper end 20 and a lower end 22. The drum 14 is rotatably mounted on the frame 12 by means of bearings 24 mounted to the frame which engage races 26 formed on the circumference of the shell 30 of the drum. A motor 32 rotatably drives a tire 34 in driving engagement with the circumference of the drum shell 30 to rotate the drum 14 in a conventional manner. Alternatively, the motor can drive a sprocket which, through a chain, engages a sprocket on the drum surface.

The cylindrical fixed or stationary sleeve 16 is concentric with the rotary drum 14 and thus also has its longitudinal axis inclined with respect to horizontal so as to have an upper end 40 and a lower end 42. The sleeve 16 is fixedly mounted to the frame 12 on a plurality of supports 44. The lower end 22 of the drum 14 is received from rotation within the sleeve 16. The inner diameter of the sleeve 16 is larger than the outer diameter of the drum 14 such that the sleeve and drum define an annular space 50 therebetween. Annular gaskets 52 at each end of the sleeve seal the openings between the drum 14 and the sleeve 16, by slidably engaging annular rings 53 which extend upwardly from the drum 14. However, the seal provided by the gasket 52 is not airtight and permits a leakage of air past the gasket, to the advantage hereinbelow described.

The drum 14 has a burner 54 mounted in its lower end 22 for directing a flame 56 into the interior of the drum. The burner 54 is of conventional design well known to those skilled in the art and can be of an oil-, natural gas-, LP gas-, or coal-burning design. A fan 58 charges a mixture of fuel and air into the burner 54, where it is ignited to produce the flame 56 for heating the interior of the drum. The operation of the burner 54 and an exhaust fan (not shown) creates a flow of heated air from the lower end 22 of the drum 14, through the drum, and out the upper end 20 of the drum. The exhaust airflow exiting the upper end 20 of the drum 14 is ducted to a conventional dust filtering device (not shown), such as a baghouse, cyclone separator, or wet-wash system, and thence through through the fan and a stack to the atmosphere.

A chute 60 is disposed at the upper end 20 of the drum 14 for introducing virgin aggregate through an inlet 62 into the interior of the drum. The drum 14 further comprises a pluraity of flights (not shown) of conventional design mounted to the inner circumference of the drum for lifting material as the drum rotates and tumbling it through the heated air flowing through the drum. In this manner, a material introduced through the inlet 62 is dried and heated as it is moved down the drum. A plurality of openings 70 in the wall of the shell 30 at the lower end 22 of the drum 14 discharge material from the interior of the drum into the lower end 42 of the sleeve 16.

Figure 2:
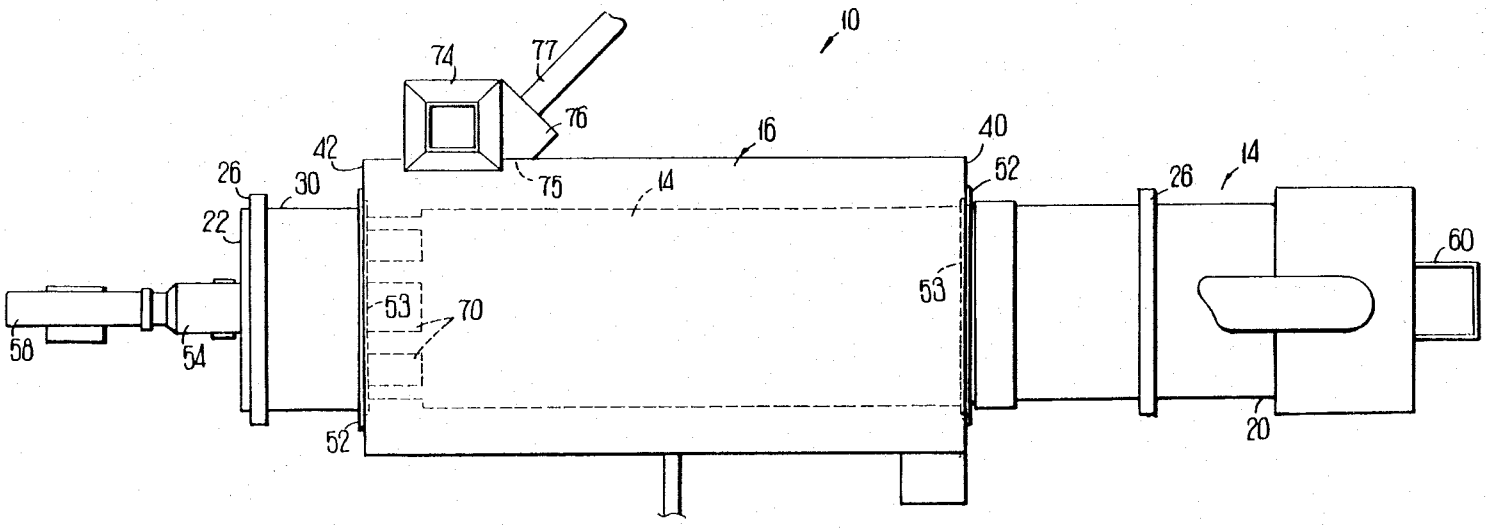
FIG. 2 is a top plan view of the asphalt plant of FIG. 1.

Also shown in FIG. 2 is a fines inlet 75 for the introduction of mineral fines, dust recovered by the dust filtering device, or other additives. The inlet 75 includes a box 76 attached to an opening in the sleeve 16 located between the inlet 74 and the liquid asphalt supply pipe 86. A supply line 77 delivers fines or dust to the box 76, and thence into the sleeve 16, by means of an auger, or pneumatically.

Figure 3:
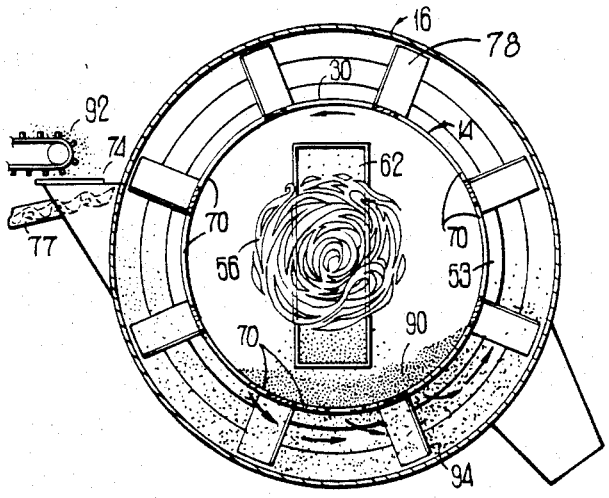
FIG. 3 is a cross-sectional view of the asphalt plant of FIG. 1 taken along line 3—3 of FIG. 1.

Referring now to FIG. 3, an inlet 74 permits material such as recycleable asphalt pavement to be introduced from outside the apparatus 10 directly into the annular space 50 between the drum 14 and the sleeve. The inlet 74 is preferably located upwardly from the discharge openings 70, but sufficiently spaced from a liquid asphalt supply pipe 86 (described below) to allow mixing of the aggregate and recycleable pavement before liquid asphalt is applied. A plurality of paddle-like flights or mixing blades 78 are mounted on the outer circumference of the shell 30 along the portion of the drum 14 received within the sleevw 16. The flights 78 are dimensioned such that, as the drum 14 rotates, the flights traverse the annular space 50 between the drum and the sleeve 16. The flights 78 are angled to move material in the sleeve 16 from the lower end 42 of the sleeve toward its upper end 40. The flights 78 act in much the same manner as a screw auger, mixing the material as it is moved up the sleeve.

Figure 4:
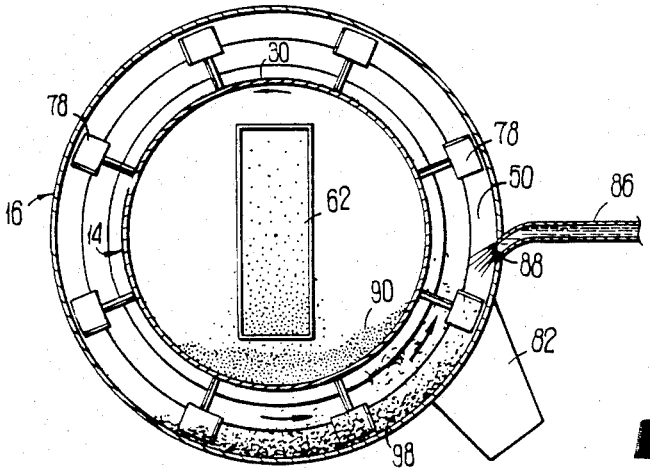
FIG. 4 is a cross-sectional view of the asphalt plant of FIG. 1 taken along line 4—4 of FIG. 1.

Referring now to FIG. 4, a liquid asphalt supply pipe 86 communicates with the annular space 50 between the drum 14 and the sleeve 16 obliquely through an opening partway up the wall of the cylindrical sleeve. A spray nozzle 88 on the end of the supply pipe 86 is directed downwardly toward the bottom of the sleeve 16 to spray materials in the bottom of the fixed sleeve mixer with liquid asphalt. The liquid asphalt supply pipe 86 can be disposed at any point along the length of the fixed sleeve 16 so long as the aggregate and recycleable material are mixed before they reach the liquid asphalt spray, and so long as the liquid asphalt is afforded an adequate opportunity to become thoroughly intermixed with the material in the sleeve before the material is discharged from the upper end 40 of the sleeve.

Figure 5:
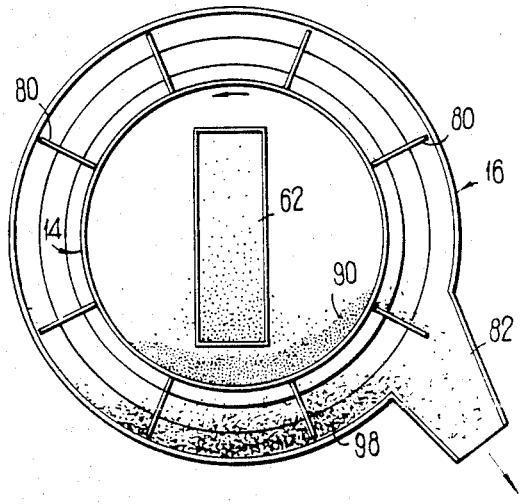
FIG. 5 is a cross-sectional view of the asphalt plant of FIG. 1 taken along line 5—5 of FIG. 1.

Referring now to FIG. 5, as the material reaches the upper end 40 of the sleeve 16, a series of high lift flights 80 mounted on the outer circumference of the shell 30 of the drum 14 lift the mix material to a discharge outlet 82, through which it is discharged into a conveyor (not shown) which carries the finished mix to a surge bin (not shown).

Referring now to the operation of the asphalt plant 10 of the present invention, aggreggate 90 is introduced into the chute 60 at the upper end 20 of the rotating drum 14 and into the interior of the drum through the inlet 62. It will be understood that the chute 60 is preceded by conventional aggregate storage, sizing, weighing, and conveying apparatus well known to those skilled in the art, which apparatus forms no part of the present invention. The flame 56 from the burner 54 mounted in the lower end of the drum 14 heats the interior of the drum and generates a flow of heated air through the drum and out the upper end 20 of the drum. As the drum 14 rotates, the aggregate 90 is showered through the flow of heated air and is heated and dried as it travels down the drum toward the lower end 22. As the heated and dried aggregate 90 reaches the lower end 22 of the drum 14, it is discharged through the openings 70 in the shell 30 at the lower end of the drum and into the lower end 42 of the sleeve 16. The aggregate 90 is discharged from the lower end 22 of the drum at a temperature somewhat higher than the desired temperature of the final mix. The exhaust airflow, including steam from the drying of the aggregate and dust particles from the tumbling of the aggregate, exits the upper end 20 of the drum and is ducted to the dust collection system in the conventional manner.

RAP 92 is introduced through the inlet 74 into the annular space 50 at the lower end 42 of the sleeve 16 for mixing with the heated and dried aggregate 90. It will be understood that the inlet 74 is preceded by conventional RAP storage, sizing, weighing, and conveying apparatus well known to those skilled in the art, which apparatus forms no part of the present invention. The flights 78 on the exterior of the rotating drum 14 mix the aggregate 90 and RAP 92 into a mixture 94 and move it up the sleeve 16. A the two components mix, the RAP is heated by contact with the hot aggregate, by conductive heat from the flights 78, 80 and by radiant heat from the hot shell 30 of the drum 14. As the RAP is heated, the asphaltic content of the RAP begins to melt, and a portion of the asphaltic content is transferred to the virgin aggregate. However, at all times during the manufacturing process, the RAP is shielded by the shell 30 of the drum 14 from the direct radiant heat of the flame 56. In this manner, heating of the RAP is accomplished without burning or smoking the asphaltic content of the RAP.

Further up the sleeve 16, mineral fines, either dust recovered from the dust-filtering device or mineral fines from a fines storage bin, are introduced through the dust supply conduit 77 into the sleeve. Conventional metering and control apparatus well known to those skilled in the art are employed to control the rate at which the mineral fines are introduced into the apparatus. The mineral fines are mixed with the aggregate and RAP by the flights 78 on the exterior of the rotating drum 14 as the materials are conveyed up the sleeve toward its upper end 40.

Still further up the sleeve 16, liquid asphalt 96 is introduced by the supply pipe 86 and spray nozzle 88 into the mixture 94 of aggregate and RAP. It is once again understood that the supply pipe 86 is preceded by conventional liquid asphalt storage tanks and metering apparatus which do not form a part of the present invention. The aggregate, RAP, fines, and liquid asphalt are mixed into a mixture 98 by the flights 78 on the exterior of the rotating drum 14 and moved up the sleeve 16 towards its upper end 40. By the time the mixture 98 has reached the discharge outlet 82 at the upper end 40 of the sleeve 16, the mixture is substantially homogeneous and is suitable for use as an asphalt paving composition. From the discharge outlet 82, the paving composition can be conveyed to a waiting truck for transport to a job site, or it can be conveyed to a bin for storage.

It will be appreciated that the proportions of aggregate, RAP, fines, and liquid asphalt in the paving composition, and the apparatus for measuring and controlling the rates at which the various components are introduced into the apparatus to maintain the desired proportions, are well-known to those skilled in the art.

It will further be appreciated that the desired "exit temperature" of the heated aggregate discharged from the lower end of the drum will depend upon several factors. As seen, the aggregate must be heated to a sufficient temperature that the RAP which comes into contact with the aggregate in the sleeve will be heated. Conversely, the aggregate should not be heated to such a temperature that RAP and liquid asphalt which comes into contact with the aggregate will burn and smoke. It will thus be understood that the desired exit temperature of the aggregate discharged from the drum will depend on the amount of RAP being introduced into the mix, and that the intensity of the burner flame and air flow within the drum should be controlled to provide an exit temperature which is sufficient to melt the amount of RAP being used without causing smoking and burning. Depending upon the apparatus and the materials used, an exit temperature of about 665° F. might provide a final mix temperature of about 300° F.

The present invention affords a number of advantages over prior-art drum mixing apparatus. Since the liquid asphalt and RAP are mixed with the aggregate in a vessel separate from the drum in which the aggregate is heated and dried, the drum can employ a counterflow design, which is more thermally efficient than the parallel flow design required in prior art drum mixers. The present invention thus affords the advantage of permitting the aggregate to be dried in a counterflow dryer, while mixing occurs in a separate vessel shielded from the intense heat of the burner by the walls of the drum.

While advantages in thermal efficiency are to be gained by mounting the burner in the lower end of the drum in the aforementioned counterflow design, it will be understood that the present invention can also be practiced by mounting the burner in the upper end of the drum in a concurrent flow or parallel flow arrangement, though a certain loss in efficiency will result.

Another feature of the present invention is the venting of any smoke generated in the fixed sleeve through the ports into the drum adjacent the burner flame, where the smoke is incinerated. The flow of heated gases through the drum resulting from normal operation of the burner will cause a drop in pressure within the drum. This low pressure area causes a slight flow of air past the gasket 52 sealing the end of the sleeve 16, through the ports 70 proximate the lower end 22 of the drum 14, and into the drum at a point adjacent the burner 54. Thus, any smoke which may be generated in the mixing sleeve by the accidental exposure of the RAP or liquid asphalt to excessively hot aggregate will be drawn from the annular space 50 through the ports 70 in the lower portion of the drum 14 and into the burner flame 56, where the smoke will be incinerated. Thus, the quality of the exhaust emissions will be improved.

Yet another feature of the present invention is the protection of liquid asphalt and RAP from exposure to the steam generated by the drying aggregate. In a prior art drum mixer, liquid asphalt and RAP in the lower end of the drum is exposed to steam generated by the heating and drying of the aggregate in the upper end of the drum. This exposure to high temperature steam can strip light end hydrocarbons from the asphalt, causing blue smoke and pollution problems. The light end hydrocarbons can condense when they come into contact with a cooler surface, such as the baghouse. Condensation of light end hydrocarbons in the baghouse can lead to clogging of the bags, reducing plant capacity, or even lead to a baghouse fire. However, the present invention overcomes this problem, in that the liquid asphalt and RAP are never exposed in the drum but instead are maintained within the concentric sleeve. The steam from the heating and drying of the aggregate is thus swept out of the upper end of the drum without ever contacting the liquid asphalt. Any steam generated by the heating of the RAP in the sleeve is also drawn away from the liquid asphalt into the drum, as described above.

A further advantage of the present invention over prior art drum mixers is that for a given plant capacity the apparatus can be substantially more compact and thus more portable. In a prior art drum mixer, not only must the drum be sufficiently long that liquid asphalt and RAP can be introduced far enough away from the flame to prevent smoking; but also the drum must still provide sufficient length below the point of introduction of the liquid asphalt and RAP to permit adequate mixing of the components in the lower portion of the drum. In the present invention, the length of the apparatus is dictated only by the length of drum necessary to heat and dry the aggregate. Since the mixing takes place in the annular space between the drum and the concentric sleeve, the mixing apparatus does not add to the length of the drum, thereby permitting a shorter apparatus.

Those skilled in the art will understand from the foregoing that an apparatus according to the invention can be utilized to form a paving composition either entirely from virgin aggregate and liquid asphalt or from raw materials consisting in part of recycleable pavement. Although an inlet for rcycleable products is provided in the preferred embodiment, important advantages of the invention are provided in a plant which does not have such an inlet. Furthermore, it should be understood that the invention may be practised utilizing a stationary sleeve that does not completely surround the inner rotary drum.

While the present invention provides the advantages of separate drying and mixing vessels, it does not suffer some of the disadvantages of prior art continuous mix plants utilizing separate dryers and mixers. First, the present invention is significantly more portable than transporting separate components. Further, there is no need to coney superheated aggregate from one vessel to another, since in the present invention the aggregate merely drops from the dryer into the mixing sleeve by force of gravity. Finally, the present design does not suffer the increased complexity of separate drive trains and the additional energy expense of rotatably driving a dryer and a separate mixer.

Finally, it will be understood that the present invention is disclosed by way of example, and that other modifications may occur to those skilled in the art without departing from the scope and spirit of the appended claims.

What is claimed is:

1. An apparatus for manufacturing asphalt paving composition, comprising:

a drum having a longitudinal axis inclined with respect to horizontal such that said drum has an upper end and a lower end;

a fixed sleeve having a semicylindrical lower portion concentric with said drum, said sleeve being disposed to receive an intermediate portion of said drum therewithin such that portions of said drum extend above and below said sleeve, said fixed sleeve having an upper end and a lower end, said drum and said semicylindrical lower portion of said fixed sleeve defining a semiannular space therebetween;

means longitudinally space apart from said fixed sleeve for supporting said portions of said drum which extend above and below said sleeve such that said drum is supported for rotation about said longitudinal axis;

means for heating the interior of said drum;

means for introducing aggregate into the upper end of said drum for heating and drying;

means for discharging the heated and dried aggregate from said drum into said semiannular space between said drum and said fixed sleeve at the lower end of said sleeve;

means operatively associated with said drum for mixing a material in said semiannular space between said drum and said fixed sleeve and for moving a material in said semiannular space toward the upper end of said fixed sleeve;

means for introducing liquid asphalt into said fixed sleeve along with said aggregate for mixing therewith, whereby said liquid asphalt is mixed with said aggregate, and whereby the mixutre of aggregate and liquid asphalt is moved toward the upper end of said fixed sleeve; and means for discharging said mixture of aggregate and liquid asphalt from said fixed sleeve for use as an asphalt paving composition.

2. The apparatus of claim 1, further comprising means for introducing recyclable asphalt pavement into said semiannular space along with said heated and dried aggregate.

3. The apparatus of claim 1, wherein said means operatively associated with said drum for mixing a material in said semiannular space between said drum and said fixed sleeve and for moving a material in said semiannular space toward the upper end of said fixed sleeve comprises a plurality of fights mounted on the exterior of said drum such that said flights traverse said semiannular space between said drum and said fixed sleeve to mix a material in said semiannular space and move said material toward the upper end of said fixed sleeve.

4. The apparatus of claim 1, wherein said means for heating the interior of said drum comprises a burner mounted in the lower end of said drum.

5. The apparatus of claim 4, wherein said semiannular space between said drum and said fixed sleeve is vented to the interior of said drum at a point adjacent said burner such that gases in said semiannular sace are drawn into the flame of said burner.

6. An apparatus for manufacturing asphalt paving composition, comprising:

a drum having first and second ends;

a stationary sleeve mounted concentrically around an intermediate portion of said drum such that portions of said drum extend above and below said sleeve, said sleeve having an input end and an opposite discharge end, and said drum and said sleeve defining a semiannular space therebetween;

means longitudinally spaced apart from said sleeve for supporting said portions of said drum which extend above and below said sleeve for mounting said drum for rotation about its longitudinal axis;

means for heating the interior of said drum;

means for introducing aggregate into said drum at said first end thereof;

means for rotating said drum, moving said aggregate from said first end toward said second end, and discharging said aggregate from the interior of said drum into said annular space at said input end of said sleeve;

means for introducing liquid asphalt into said sleeve into contact with said aggregate;

means rotating with said drum for moving said aggregate within said annular space from said input end of said sleeve toward said discharge end of said sleeve and for mixing said liquid asphalt with said aggregate; and means for discharging a mixture of aggregate and liquid asphalt from said discharge end of said sleeve.

7. The apparatus of claim 6, further comprising means for introducing recycleable asphalt pavement into said semiannular space between said drum and said sleeve.

* * * * *